US005409273A

United States Patent [19]

Claar et al.

[11] Patent Number: 5,409,273

[45] Date of Patent: Apr. 25, 1995

[54] LOCKING-AID DEVICE FOR A LOCK

[75] Inventors: Klaus-Peter Claar, Gechingen; Martin Lindmayer, Leonberg; Jan Schilling, Gechingen; Andreas Schmidt, Stuttgart, all of Germany

[73] Assignee: Mercedes Benz AG, Stuttgart, Germany

[21] Appl. No.: 19,699

[22] Filed: Feb. 19, 1993

[30] Foreign Application Priority Data

Feb. 21, 1992 [DE] Germany ..... 42 05 269.6

[51] Int. Cl.[6] ..... E05C 3/26

[52] U.S. Cl. ..... 292/201; 292/DIG. 43; 292/DIG. 14

[58] Field of Search ..... 292/201, DIG. 14, DIG. 43

[56] References Cited

U.S. PATENT DOCUMENTS

| | | | |
|---|---|---|---|
| 3,016,968 | 1/1962 | Lenz et al. . | |
| 3,113,447 | 12/1963 | Oishei | 292/201 X |
| 3,504,511 | 4/1970 | Allen | 292/201 X |
| 4,569,544 | 2/1986 | Escaravage | 292/201 X |
| 4,616,862 | 10/1986 | Ward | 292/201 |
| 4,906,035 | 3/1990 | Nagai et al. | 292/201 |
| 4,961,601 | 10/1990 | Lindholm et al. | 292/DIG. 14 X |
| 4,974,885 | 12/1990 | Yokoyama | 292/201 |
| 4,976,477 | 12/1990 | Nakao | 292/201 |
| 4,998,758 | 3/1991 | Kowalczyk et al. | 292/201 |
| 5,020,838 | 6/1991 | Fukumoto | 292/201 |
| 5,074,603 | 12/1991 | Brackmann | 292/201 X |
| 5,222,775 | 6/1993 | Kato | 292/201 |
| 5,273,324 | 12/1993 | Kobayashi | 292/201 |
| 5,288,115 | 2/1994 | Inoue et al. | 292/201 |

FOREIGN PATENT DOCUMENTS

| | | | |
|---|---|---|---|
| 159238 | 10/1985 | European Pat. Off. | 292/201 |
| 3512645 | 10/1986 | Germany . | |
| 3935804 | 10/1989 | Germany . | |
| 3935804 | 5/1990 | Germany . | |
| 3939768 | 6/1991 | Germany . | |

*Primary Examiner*—Peter M. Cuomo
*Assistant Examiner*—Suzanne L. Dino
*Attorney, Agent, or Firm*—Evenson McKeown Edwards & Lenahan

[57] ABSTRACT

A locking-aid device is disclosed for a lock, especially for a vehicle door lock or flap lock, in which a pneumatic single-acting locking-aid drive is provided for displacing an abutment for a rotary latch out of a catch position into a locking position, in which the abutment is secured positively by means of a detent pawl. According to the invention the detent pawl can be lifted out, during the opening of the lock, independently of a movement of the locking-aid drive by means of an operative connection. This can be brought about purely mechanically or by means of a separate drive for lifting out the detent pawl during the opening of the lock, so that the abutment can always jump into its catch position immediately during or after the opening of the lock and thus also allows a successive multiple activation of the locking-aid assistance.

15 Claims, 2 Drawing Sheets

LOCKING-AID DEVICE FOR A LOCK

BACKGROUND AND SUMMARY OF THE INVENTION

The invention relates to a locking-aid device for a lock of the type used for the lock of the boot lid of the vehicle series W 140 produced by Mercedes. A published description of the lock, with references to the actuation of the locking aid, can be taken from German Patent Document DE 3,935,804 C2. The pneumatic locking-aid drive described is a single acting spring-returned diaphragm-piston servomotor which is operated at an overpressure of approximately 2.5 hPa on account of the high locking forces which occur when the abutment locking wedge is being drawn out of its catch position into the locking position.

When the lock is being opened, for example by pressing in the associated lock cylinder manually, the known locking-aid drive is extended in response to a signal from a microswitch detecting the position of the rotary latch of the lock and, in the course of this stroke, lifts out by means of a mechanism the detent pawl which keeps the extendable abutment, in the form of a locking wedge having a closed locking lug, in the retracted locking position. A spring can thereupon, in principle, push the locking wedge into its extended catch position. The advantage of the chosen arrangement is that only a single drive has to be provided for the locking-aid and the release functions.

However, in view of this, the movement of the abutment into the catch position is possible only when the locking-aid drive itself has also been brought into its position of rest, that is to say the pressure prevailing in it first has to be reduced. For the purpose of noise reduction, the pressure is not reduced abruptly, but only in a throttled manner.

Moreover, a relatively long time is also taken up in building up in the locking-aid drive the pressure which is not per se required in this amount for releasing the detent pawl.

Overall, the assumption of the (extended) locking-wedge catch position, in which the locking aid is made available, can be appreciably delayed in relation to the opening of the lock. Normally, it is true that this can be accepted without difficulty. But if the boot lid is to be closed again immediately after an unintentional opening, said delay can in fact be quite troublesome.

The vehicles mentioned in the introduction also have arranged in them near the lock a further (pneumatic) auxiliary drive which is intended for extending and retracting a handle for the boot lid and which can be operated at a relatively low overpressure level of 0.6 hPa via a separate pneumatic (dual-pressure) system and is activated immediately with the opening of the lock, so that the vehicle user is offered a dirt-free handle for lifting the boot lid.

Likewise known from German Patent Document DE 3,939,768 A1 is a movable handle for a vehicle boot lid, which is coupled kinematically to a rotary latch of the lid lock via a pivoting linkage and which, in the release position of said rotary latch, can be pivoted out of its concealed position of rest when the lid is closed.

It is also known per se from U.S. Pat. No. 3,016,968 to lift out a detent pawl by means of a single-acting pneumatic (underpressure) drive, in order to make it possible, for the remote-controlled opening of a boot lid, to bring a rotary latch of the boot-lid lock into its release position, said rotary latch being under spring prestress and being held in the locking position by the detent pawl.

German Patent Document DE 3,512,645 A1 also describes a device for actuating a tailgate lock, in which a detent pawl for a rotary latch of a lock can be lifted out by means of an electromagnetic drive upon actuation of an electrical control switch.

An object of the invention is to design a locking-aid device of the relevant generic type, in such a way that a repeated activation of the locking-aid drive in quick succession is possible.

This object is achieved, according to the invention, by providing a locking-aid device for a lock, especially for a vehicle door lock or flap lock, which has an abutment movable to and fro between a catch position assumed automatically during the opening of the lock and a locking position, especially a locking wedge having a closed locking lug, for a movable lock latch, comprising:

a locking-aid drive which is movable out of a position of rest during the locking of the opened lock for the purpose of bringing the abutment out of the catch position into the locking position, a detent pawl for fixing the abutment in its locking position after the return of the locking-aid drive uncouplable from the abutment into its position of rest, and a drive device for automatically lifting out the detent pawl, during the opening of the lock, by means of an operative connection, wherein the drive device for lifting out the detent pawl by means of the operative connection is actuable independently of the locking-aid drive remaining in the position of rest, whereby the abutment can be moved automatically into its catch position immediately whenever the lock is opened, without the activation of the locking-aid drive.

The detent pawl can now be lifted out, during the opening of the lock, independently of a movement of the locking-aid drive by means of an operative connection. The locking-aid drive thus now no longer has to be activated during the opening of the lock, with the effect of a reduction of wear.

It would be possible, in principle, to couple the abutment detent pawl mechanically in a suitable way to the lifting-out mechanism for the rotary-latch detent pawl, in such a way that the two can be lifted out simultaneously or at least shortly after one another in the course of a manual opening-release movement. However, this seems to involve a relatively high outlay in view of the fact that the rotary-latch lock and its abutment are fastened to different constructional parts moving relatively far away from one another, namely, for example, the boot-lid edge and boot-lid frame, so that a mechanical operative connection would have to be guided by way of the hinge side of the lid (Bowden pull) or at all events would have to be uncoupled mechanically during the opening of the lid.

The latter would be possible, for example, with a pressure-pin/pressure-plate connection or the like in the locking gap, whilst the movement of the lock cylinder, when it is being pressed in, could be transmitted not Only directly to the rotary-latch detent pawl, but also, in a branch, to the abutment detent pawl, if appropriate with a lead. A lead could be brought about by an idle stroke or by utilizing the peripheral travels of a pivoting lever which are dependent on the distance from the pivot axis.

In any event, in comparison with the known locking-aid device, actions on the construction of the existing structures would be necessary.

Presupposing a leading release of the abutment closure, during opening the lock would then behave as follows: The user presses in the associated lock cylinder or pulls a door handle. Via the mechanical operative connection, the abutment detent pawl is lifted out and the abutment jumps into its catch position. Now, before the actual lock is released, the door or lid opens a little way, into the position in which the locking aid can be activated during the closing operation. In the course of the further movement of the lock cylinder or door handle, the rotary-latch detent pawl is now lifted out, and the door or lid can be opened completely, if appropriate the mechanical coupling in the locking gap being separated.

If, in contrast to this, according to another embodiment, a further independent drive is employed directly for lifting out the detent pawl, a reliable remedy, which is simple in purely constructive terms and which can be implemented quickly, against the undesirable delay discussed in the introduction is presented. Under the conditions discussed above, it is possible to have recourse in a cost-effective way to equipment already present in the vehicle for the independent operation of the further drive, since the activation of the handle drive via another quick-reacting pneumatic system means that the hardware prerequisites are already largely installed. It is merely necessary to lay a branch line from the existing system to the detent-pawl lifting out drive, and if appropriate a vent valve is also additionally installed.

Other objects, advantages and novel features of the present invention will become apparent from the following detailed description of the invention when considered in conjunction with the accompanying drawings.

DETAILED DESCRIPTION OF THE DRAWINGS

Figure 1:
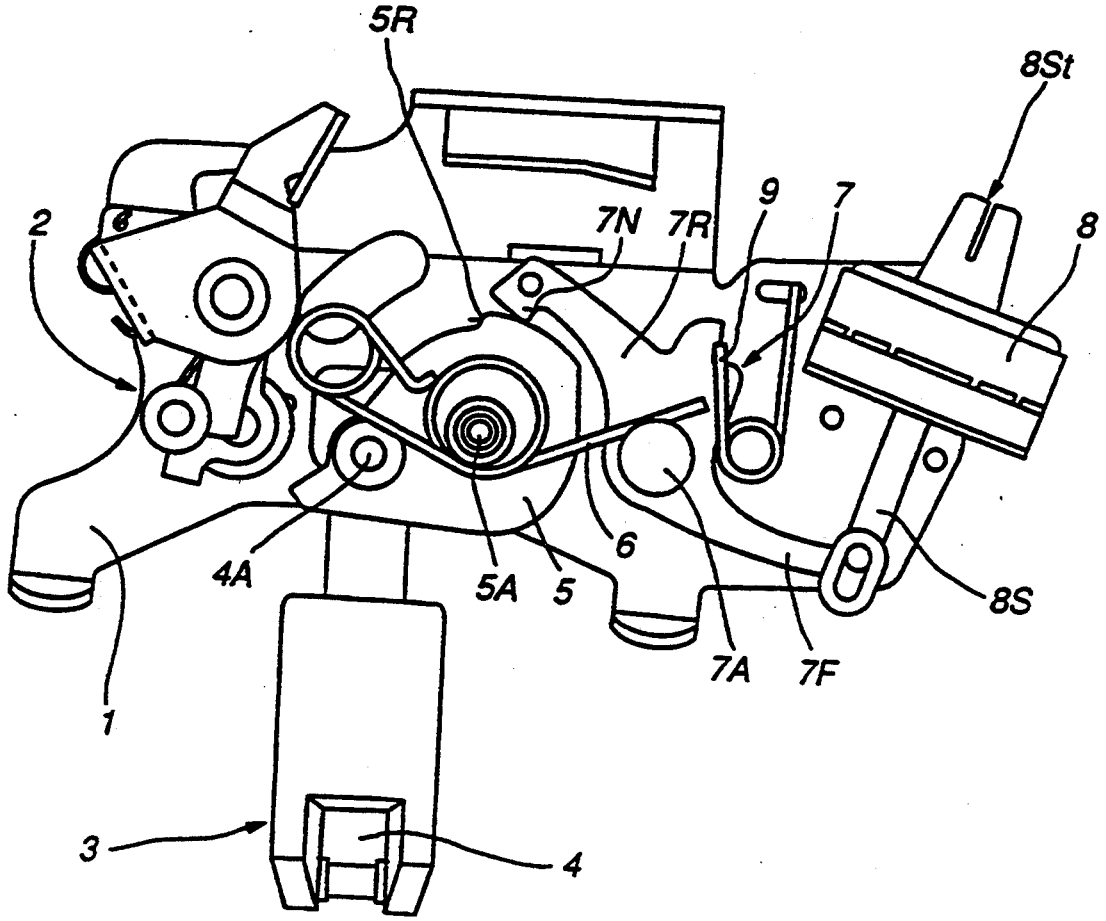
FIG. 1 is a partial schematic view of a lock assembly, showing a diagrammatic representation of the lifting-out drive coupled to the detent pawl, and of a lock system constructed according to a preferred embodiment of the invention.

According to FIG. 1, a lever mechanism 2 is arranged for transmitting actuating movement of a locking-aid drive, not shown here, to an abutment 3 in the form of a locking wedge linearly displaceable relative to the carrier plate 1 and having a closed locking lug 4. A forked rotary latch (not shown) of the flap lock, which forked rotary latch is secured in the locking position by a detent pawl, comes into engagement with the abutment 3 in a generally known way when the flap is closed. An integral part of the lever mechanism 2 is, in particular, a pivoting lever 5 which is pivotable about an axis 5A and which is coupled in an articulated manner to the abutment 3 in a joint 4A. The jam-free conversion of the pivoting movement of the pivoting lever 5 into the linear movement of the abutment 3 is made possible by a specific transverse play in the joint 4A. Pivoting lever 5 has a notch 5R on its circumference. By means of a two-armed wire spiral spring 6 which acts on the joint 4A and which is supported at the other end on an axle pin 7A, the pivoting lever 5 is resiliently prestressed in the anti-clockwise direction relative to the axis 5A. The force of the spring 6 automatically drives the abutment 3 downwards towards its catch position. In each locking-aid operation, in which the abutment 3 moves out of the catch position shown and upwards in the direction of the carrier plate 1 (and at the same time locks the flap via the rotary latch which is in the locking position), said force has to be overcome in addition to a pressing force of a gasket for the flap or door to be closed.

To counter the spring force reliably in the upper locking position of the abutment 3, a detent pawl 7 designed as a two-armed lever is also arranged pivotably on the carrier plate 1 about the axle pin 7A. Detent pawl 7 includes a catch nose 7N arranged on an arm 7N pointing in the direction of the mechanism 2, which nose 7R engages, in the position of rest (not shown), behind the notch 5R of the pivoting lever 5 and retains the latter positively in the upper locking position of the abutment 3.

For the further particulars of the functioning of the lock, attention is drawn to the published state of the art mentioned in the introduction. In particular, it is also described there how the abutment is supported, in the catch position, against moving back in front of the engaging rotary latch.

Articulated on a second arm 7F of the detent pawl 7, which points away from the mechanism 2, is an actuating member 8S likewise fastened to the carrier plate 1 and belonging to a pneumatic single-acting actuating drive 8 which is connected in a way not shown here to a supply system via a pneumatic plug connection 8St and which can be activated for the purpose of lifting out the detent pawl catch nose 7N from engagement with the notch 5R. The detent pawl 7 is likewise prestressed in the anti-clockwise direction relative to the axle pin 7A by means of a wire spiral spring 9. The drive 8 has to overcome the spring force when the detent pawl 7 is being lifted out.

Figure 2:
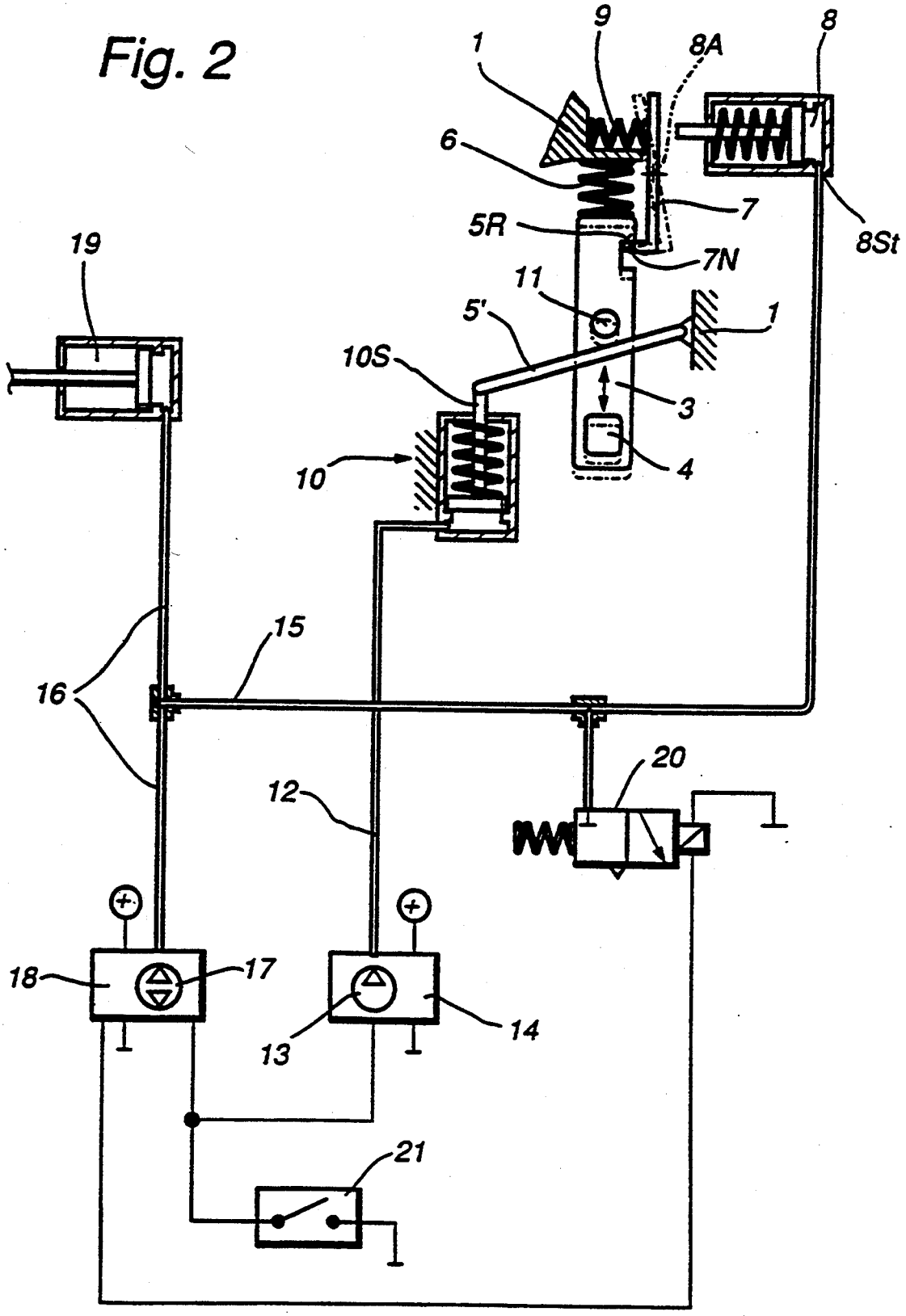
FIG. 2 shows a diagrammatic circuit diagram of the locking-aid system for the lock system of FIG. 1.

The electropneumatic circuit diagram according to FIG. 2 shows the essential components of the entire arrangement of the locking-aid device in greatly simplified form. Reference symbols from FIG. 1 have been adopted for like components. The abutment 3 movable linearly according to the marked double arrow is here shown engaged directly with the detent pawl 7 (a simplification); that is to say shown in its locking position. The catch position (locking-aid readiness position) is also indicated here by dot-and-dash lines.

For a clearer understanding, the reference symbol 5R from FIG. 1 has been readopted for the notch in engagement with the catch nose 7N of the detent pawl 7. The two wire spiral springs 6 and 9 are symbolized here merely as helical compression springs.

As already mentioned above, a locking-aid drive 10 having an actuating member 10S is designed as a single-acting pneumatic actuating drive which acts counter to a return spring, reciprocating piston elements with diaphragm pistons conventionally being used, but those with displaceable pistons, as shown, can also be employed. The actuating member 10S is coupled to a pivoting lever 5' (a simplification) which is pivotably mounted, in a plane extending parallel to the plane of the abutment 3, on the carrier plate 1, indicated here merely symbolically as a framework.

The abutment 3 is equipped here with a lever 11 (a simplification) which can be brought into contact with the pivoting lever 5' as soon as the detent pawl 7 is lifted out by the actuating drive 8 into the release position indicated by dot-and-dash lines. It is then driven automatically downwards by the spring 6 into the catch position, the contact between the pivoting lever 5' and the lever 11 forming a limit stop for the downward movement.

The single working chamber of the locking-aid drive 10 is connected by way of a compressed-air line 12 to a pump 13 connected to the vehicle electrical system and which is part of a supply unit 14 and intended for the locking-aid device. The pump 13 feeds an overpressure of approximately 2.5 hPa to the line 12 and also into further lines (not shown), as required, via switchable valves, which further lines lead, for example, to locking-aid drives on further door locks or flap locks of the vehicle.

The single working chamber of the actuating drive 8 provided for lifting out the detent pawl 7 is connected by way of a compressed-air line 15 and a main line 16 to a further pump 17 which is itself part of a (dual pressure) supply unit 18 connected to the vehicle voltage. The pump 17 symbolized as a dual-pressure generator (overpressure and underpressure) supplies, for example, by way of the main line, a further bistable actuating drive 19 which serves in a known way for the extension and retraction of a flap handle (not shown).

Furthermore, the pump 17 can be employed as a central unit for a central-locking system; however, the connections and valves necessary for this are not shown. It generates an overpressure of approximately 0.6 hPa, which is thus clearly lower than the pressure level which can be provided by the pump 13. The underpressure level, of no interest here, of the pump 17 is around approximately 0.4 hPa absolute.

Furthermore, also connected to the compressed-air line 15 branched off without a valve from the main line 16 is a vent valve 20 which is designed as a 2/2-way valve switchable electromagnetically counter to a returning spring force and which can be activated electrically from the supply unit 18. In its position of rest, the valve is closed, whereas, in the activated state, it makes a connection between the compressed-air line 15 (and also the main line 16) and the atmosphere.

A switching device 21, by means of which the position of the rotary latch which can be brought into engagement with the abutment 3 is detected and converted into electrical signals, is connected electrically via its associated inputs to the two supply units 14 and 17. It is the releasing member during the opening of the flap lock for extending the handle by means of the actuating drive 19 and for lifting out the detent pawl 7 by means of the actuating drive 8, in that a corresponding signal is fed at least to the supply unit 18.

During the closing of the flap lock, the switching device 21 is the releasing member for retracting the handle (supply unit 18) and for the locking-aid function or the activation of the locking-aid drive 10 via the supply unit 14.

A case distinction between the opposite movements of the rotary latch during the opening and closing of the flap lock can thus be expedient or necessary. For example, the switching device 21 can also comprise two successively switchable (touch-contact) switches, their actuation sequence providing said case distinction by suitable evaluation of the signal train.

The two pumps 13 and 17 are cut off, when predetermined pressure levels are reached, by pressure sensors or pressure switches, not shown here, which are integrated into the respective supply units 14 and 18. After the cut-off of the overpressure feed of the pump 17, the supply unit 18 generates a further brief activation pulse for the valve 20 which ensures a rapid venting of the line 15. In principle, this venting is also possible via a flow short-circuit of the pump 17, if this is designed, for example, as a vane-cell pump. However, in the present circumstances, it is important to have a very rapid venting, since a rapid reavailability of the locking-aid function is, of course, a primary object of the arrangement.

The detent pawl 7 must therefore be capable of engaging quickly again in order to support the abutment 3, after it has been temporarily lifted out.

The operating cycle of the locking-aid device is also outlined briefly below. During the opening of the flap lock, the actuating drives 8 and 19 are extended immediately (overpressure mode of the pump 17), in order to swing out the handle and lift out the detent pawl 7. This takes place quickly because of the relatively low operating pressure level of the pump 17. The locking-aid drive 10 remains in its retracted position of rest shown. The abutment 3 can therefore be displaced downwards immediately into its catch position under the effect of the spring 6. In order to damp impact noises possibly occurring during this process, an elastic buffer can be provided, for example, on the lever 5' or 11. The locking aid can thus now be made available already immediately after the opening of the lock.

After the pump 17 has been cut off, the valve 20 is briefly activated and vents the overpressure prevailing in the line 15 into the atmosphere. The actuating drive 8 is thereupon retracted quickly again by its return spring and releases the detent pawl 7 which itself comes to bear on the abutment 3 (or, according to FIG. 1, on the pivoting lever 5) again under the force of the spring 9 and is consequently ready for engagement (this position is shown in FIG. 1).

Now when relocking of the lock is signalled by the switching device 21—the rotary latch is during this process engaged by means of its detent pawl in its locking position in which it is in engagement with the closed locking lug 4, the handle is retracted again (underpressure mode of the pump 17) and the locking-aid drive 10 is simultaneously extended. During this process, the pivoting lever 5' presses the abutment 3 upwards via the lever 11, and the detent pawl 7 or its catch nose 7N automatically drops into the notch 5R. The lock is thus brought into its proper locking position again with the assistance of the locking aid; the pumps can be cut off.

Instead of the illustrated version of the vent valve 20, other valve constructions can, of course, also be used expediently here. For example, there can also be arranged in the line 15 a non-return valve which transmits overpressure and which, if appropriate, in the position of rest, provides an atmospheric connection for the actuating drive 8, since a loading of the actuating drive 8 with underpressure, although not causing any disturbance, is nevertheless also unnecessary.

Furthermore, it is also contemplated to use, in the branch of the line 15 from the main line 16, a 4/2-way valve which can be switched pneumatically by overpressure and which, in the state of rest and when subjected to underpressure, separates the line 15 from the main line 16 and connects it to the atmosphere. Only when it is subjected to overpressure is the line 15 connected to the main line. In such a version, the buffer effect of the line volume and drive volume on the under pressure operation of the handle actuating drive 19 can be minimized.

It should also be pointed out that only pneumatic drives have been described for the exemplary embodiment presented here; in this respect, however, hydraulic or electrical drives can also be used for pulling up the abutment, lifting out the detent pawl and extending and retracting the handle and are therefore considered as equivalents.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Locking-aid device for a lock, especially for a vehicle door lock or flap lock, which has an abutment movable to and fro between a catch position assumed automatically during the opening of the lock and a locking position, especially a locking wedge having a closed locking lug, for a movable lock latch, comprising:

a locking-aid drive which is movable out of a position of rest during the locking of the opened lock for the purpose of bringing the abutment out of the catch position into the locking position, a first detent pawl for fixing the abutment in its locking position after the return of the locking-aid drive uncouplable from the abutment into its position of rest, a drive device for automatically lifting out the first detent pawl, during the opening of the lock, by means of an operative connection, and a drive device control mechanism for actuating the drive device for lifting out the first detent pawl by means of the operative connection independently of the locking-aid drive remaining in the position of rest, whereby the abutment can be moved automatically into its catch position immediately whenever the lock is opened, without the activation of the locking-aid drive.

2. Locking-aid device according to claim 1, wherein the operative connection between the drive device, provided for lifting out a second detent pawl securing the lock latch in its locking position, and the first detent pawl for the abutment is arranged mechanically in such a way that, in the course of an especially manually initiable movement to open the lock, the first detent pawl can be lifted out jointly with the second lock-latch detent pawl.

3. Locking-aid device according to claim 2, wherein the first detent pawl can be lifted out with a lead relative to the second lock-latch detent pawl.

4. Locking-aid device according to claim 1, wherein there is provided in addition to the locking-aid drive a further actuating drive which can be activated independently of the locking-aid drive by a switching signal from a switching device, said switching signal being generatable during the opening of the lock, which further actuating drive functions as an independent drive device for lifting out the first detent pawl.

5. Locking-aid device according to claim 4, wherein both the locking-aid drive and the further actuating drive are single-acting pneumatic reciprocating-piston drives.

6. Locking-aid device according to claim 5, wherein the further actuating drive can be operated at a significantly lower pneumatic pressure than the locking-aid drive.

7. Locking-aid device according to claim 4, wherein the further actuating drive is connected, at least in one direction of activation, in parallel with a handle drive which can be activated independently of the locking-aid drive during the opening of the lock and which is provided for extending a handle of a door or flap lockable by the lock.

8. Locking-aid device according to claim 5, wherein the locking-aid drive, and the handle drive together with the further actuating drive, respectively, can be operated by means of separate pneumatic supply systems.

9. Locking-aid device according to claim 4, wherein the further actuating drive is assigned a vent valve which can be switched to reduce the overpressure operating the further actuating drive, after the first detent pawl has been lifted out.

10. Locking-aid device according to claim 9, wherein the further actuating drive is preceded by a non-return valve transmitting overpressure.

11. Locking-aid device according to claim 4, wherein the further actuating drive can be activated in dependence on the position of a rotary latch of the lock, said position being detectable by the switching device.

12. Locking-aid device according to claim 4, wherein both the locking-aid drive and the further actuating drive are reciprocating piston drives.

13. Locking-aid device according to claim 4, wherein the locking-aid drive is a reciprocating piston drive.

14. Locking-aid device according to claim 1, wherein the locking-aid drive is a reciprocating piston drive.

15. Locking-aid device according to claim 4, wherein the further actuating drive is a reciprocating piston drive.

* * * * *